US005628551A

United States Patent [19]

Block

[11] Patent Number: 5,628,551

[45] Date of Patent: May 13, 1997

[54] VALET WITH STORAGE COMPARTMENT FOR STORING ITEMS

[76] Inventor: Adee Block, 5807 Yecker Ave., Kansas City, Kans. 66104

[21] Appl. No.: 611,254

[22] Filed: Mar. 5, 1996

[51] Int. Cl.[6] ..... A47B 83/00

[52] U.S. Cl. ..... 312/235.7; 312/235.2; 297/126; 297/188.03

[58] Field of Search ..... 312/235.2, 235.5, 312/235.7, 235.9; 206/523, 562; 297/125, 126, 188.1, 188.03, 188.05, 188.07

[56] References Cited

U.S. PATENT DOCUMENTS

| | | | |
|---|---|---|---|
| D. 119,394 | 3/1940 | Minard . | |
| D. 219,660 | 1/1971 | Eccles . | |
| 319,491 | 6/1885 | King | 297/188.05 |
| 361,882 | 4/1887 | Luft | 312/235.5 X |
| 446,632 | 2/1891 | Easte | 297/126 |
| 690,103 | 12/1901 | Farish | 297/188.03 |
| 1,276,713 | 8/1918 | Biedma | 297/188.05 X |
| 1,832,642 | 11/1931 | Leff . | |
| 2,429,050 | 10/1947 | Decker . | |
| 2,759,529 | 8/1956 | Hagadorn . | |
| 3,596,754 | 8/1971 | Peterson, Jr. | 206/523 X |
| 4,165,124 | 8/1979 | Olan . | |
| 4,294,349 | 10/1981 | Ibsen et al. | 206/523 X |
| 4,883,317 | 11/1989 | Davenport . | |

*Primary Examiner*—Peter M. Cuomo
*Assistant Examiner*—Janet M. Wilkens
*Attorney, Agent, or Firm*—Litman, McMahon and Brown, L.L.C.

[57] ABSTRACT

A valet comprises a frame having a first storage box pivotally secured to the frame. The first storage box includes a front panel and a rear panel, an internal chamber formed therein and a lid for providing access to the internal chamber. The storage box is pivotally secured to the frame such that the storage box is pivotal between an upright alignment wherein the front and rear panels are substantially vertically aligned and a horizontal alignment wherein the front and rear panels are generally horizontally aligned. An elongated slot is formed in a bottom panel of the storage box and extends into communication with the internal chamber. A first layer of compressible material is secured within the internal chamber of said box and a second layer of compressible material is secured to an inner surface of the lid. A pair of pants, having a utility belt with items of equipment secured thereto secured to the pants, may be secured between the first and second layers of compressible material such that the pants legs extend through the elongated slot and hang downward when the storage box is positioned in the vertical alignment. A lid locking assembly is mounted on the storage box for automatically locking the lid in a closed alignment when advanced thereto.

19 Claims, 2 Drawing Sheets

Fig.5.
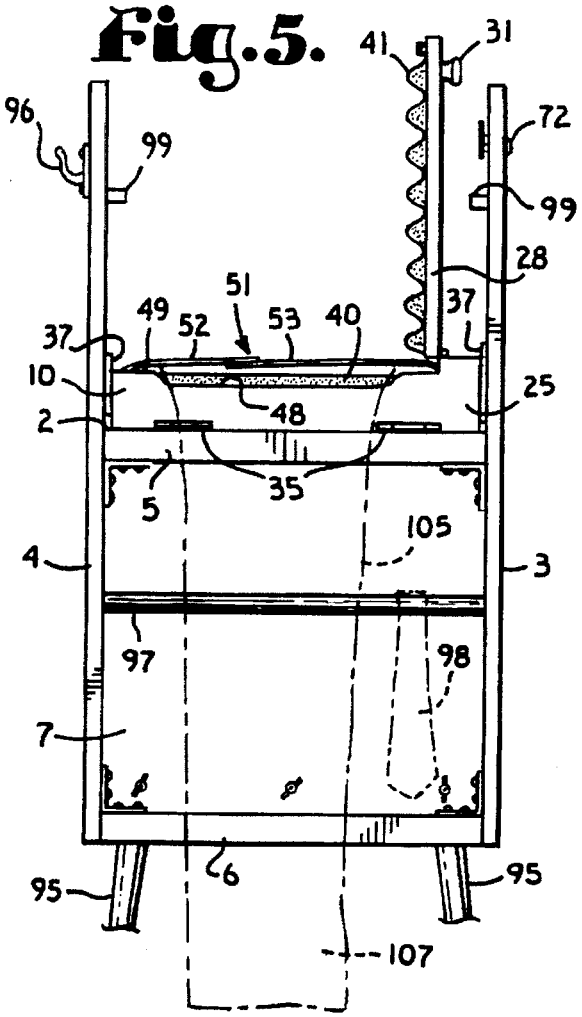
Fig.6.
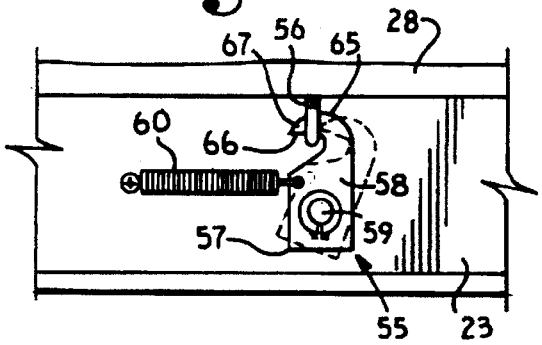
Fig.9.
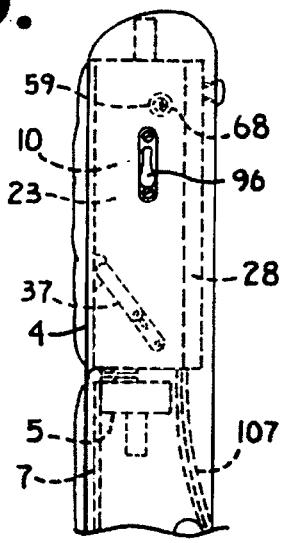
Fig.8.
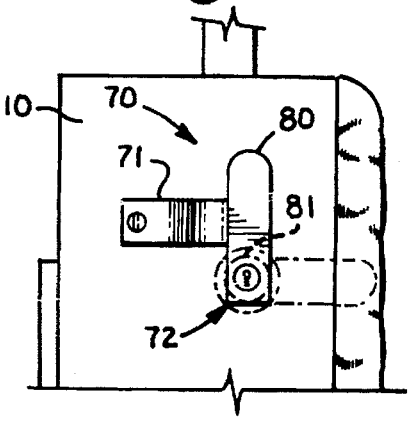
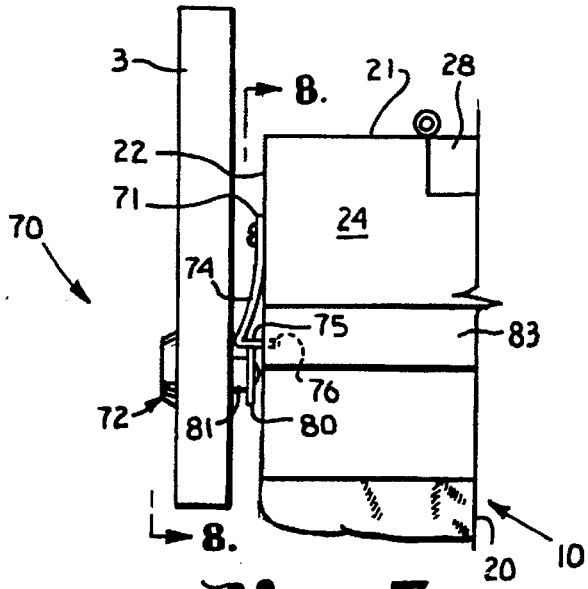
Fig.7.

VALET WITH STORAGE COMPARTMENT FOR STORING ITEMS

BACKGROUND OF THE INVENTION

The present invention relates to a valet and in particular a valet including storage compartments for securing items therein.

Law enforcement, security and military personnel often carry a considerable amount of equipment when on duty, generally in holsters or the like on their belts and pants. Equipment carried by these individuals may comprise pistols, knives, mace, handcuffs, flashlights, ammunition and the like. In view of dry cleaning costs, most of these individuals will wear their uniform pants and jacket for several shifts between cleanings. Many of these personnel store and change into their uniforms at home. Conveniently and safely storing the jacket, pants and the equipment worn with or secured to the belt of the pants between wearings poses a common problem to such individuals. Of particular concern is the safe storage of firearms.

To hang the uniform pants on a hanger or across the back of a chair or the like, the individual generally must remove the belt and all of the items of equipment secured to the belt, otherwise the weight of the equipment left on the belt and on the pants would cause the pants to slide off of the hanger or other structure on which it is hung. Further, hanging the pants on a hanger or across the back of a chair does not provide for secure storage of the equipment associated with the uniform, some of which is dangerous particularly if children are present in the house.

After the equipment is removed, most of the equipment, and in particular firearms and ammunition, should be stored in a structure which may be locked for safety purposes and to prevent theft. In most closets, where these personnel typically hang or store their uniforms, containers for securing items generally have to be stored on a shelf or on the floor and generally are not within convenient reach. Upon returning home from a shift, the process of removing all of the equipment and having to place the equipment in secure containers which are not conveniently located becomes a tiresome process.

There is a need for a device which would allow for the convenient storage of uniform pants with the belt and the equipment attached thereto left on the pants and which would allow for the secure storage of the equipment associated therewith including firearms.

SUMMARY OF THE INVENTION

The present invention comprises a valet having a frame and a lockable storage box, the upper storage box, pivotally secured to the frame between first and second side frame members. The storage box includes a front panel, a rear panel, a first side panel, a second side panel, a top panel and a bottom panel which define an internal chamber. A portion of the rear panel forms a lid secured by hinges to the storage box. An elongated cut-out is formed in the bottom panel along an edge positioned adjacent the lid when the lid is in a closed position.

The storage box is secured to the frame such that the storage box is pivotal between a vertical alignment wherein the front and rear panel are substantially vertically aligned and a horizontal alignment wherein the front and rear panel are generally horizontally aligned.

A first layer of compressible material, such as closed cell foam rubber, is secured within the internal chamber of the upper storage box. Item cut-outs are formed in the first layer of compressible material in the shape of items of equipment to be routinely positioned therein. A second layer of compressible material is secured to an inner surface of the lid of the first storage box.

First and second portions of a storage box locking assembly are mounted on the first side frame member and the first side panel respectively for selectively locking the storage box in a vertical alignment. A first lid locking assembly is mounted on the storage box for locking the lid in a closed alignment. The first lid locking assembly is positioned on the storage box such that access to the first lid locking assembly is obstructed when the storage box is positioned in the vertical alignment.

A seat generally comprising a second storage box with an internal compartment formed therein is secured to the frame between the first and second side frame members and below the upper storage box. A lockable lid extends substantially across an upper end of the second or lower storage box.

The valet is adapted for conveniently storing the equipment and pants of law enforcement personnel and the like including such pants with a belt having equipment secured thereto left on the pants. With the upper storage box pivoted down to the horizontal alignment and the lid open, the pants with the equipped belt left on, may be laid on the first layer of compressible material such that the pants legs extend across the cut-out in the bottom panel of the storage box. Larger items of equipment, such as guns and flashlights may be positioned in the specific item cut-outs provided or custom cut into the layer of compressible material. The lid is then closed and locked such that an upper portion of the pants, the portion with the belt and equipment secured thereto, is pressed between the first and second layers of compressible material to hold the pants in place.

The upper storage box is then pivoted to an upright alignment and locked in place. The pants legs hang through the cut-out in the bottom panel of the storage box. Additional items may be stored in the internal compartment in the seat.

OBJECTS AND ADVANTAGES OF THE INVENTION

It is an object of the present invention to provide a valet for use in storing articles of clothing and items of equipment; to provide such a valet particularly adapted for supporting a pair of pants having a belt with items of equipment secured thereon secured to the pants; to provide such a valet comprising a storage box pivotally secured between a pair of side frame members; to provide such a valet wherein the storage box includes a lockable lid; to provide such a valet wherein an upper portion of a pair of pants may be secured within the storage box between layers of compressible material; to provide such a valet wherein the storage box is pivotal between a vertical alignment and a horizontal alignment; to provide such a valet wherein the storage box is supported at or slightly above waist level when in the horizontal alignment to facilitate access thereto; to provide such a valet wherein the legs of a pair of pants secured in the storage box extend through an opening in a bottom panel of the storage box such that the pants legs hang downward behind a rear portion of the valet; to provide such a valet wherein item cut-outs are formed in a layer of compressible material positioned in an internal compartment of the storage box; to provide such a valet in which the lid automatically locks when advanced to a closed position; to provide such a valet in which the storage box automatically locks when advanced into a vertical alignment; to provide such a valet in which access to a locking mechanism for the lid is obstructed when the storage box is positioned in a vertical alignment; to provide such a box having a seat; to provide such a valet in which the seat includes a storage compartment formed therein; to provide such a valet which is relatively inexpensive to manufacture; to provide such a valet which may be attractively upholstered; to provide such a valet which is particularly well adapted for its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a slightly enlarged and fragmentary view taken along line 5—5 of FIG. 4 and generally comprising a rear elevational view of the valet of the present invention.

FIG. 6 is an enlarged and fragmentary, cross-sectional view taken generally along line 6—6 of FIG. 4, with the lid of the upper storage box in the closed position, showing a locking assembly for the lid of the upper storage box.

FIG. 7 is an enlarged and fragmentary cross-sectional view taken along line 7—7 of FIG. 1 showing a locking assembly for securing the upper storage box in a vertical alignment.

FIG. 8 is an enlarged and fragmentary cross-sectional view taken generally along line 8—8 of FIG. 7.

FIG. 9 is a fragmentary, right side elevational view with the upper storage box shown in phantom lines in the closed alignment.

DETAILED DESCRIPTION OF THE INVENTION

Figure 1:
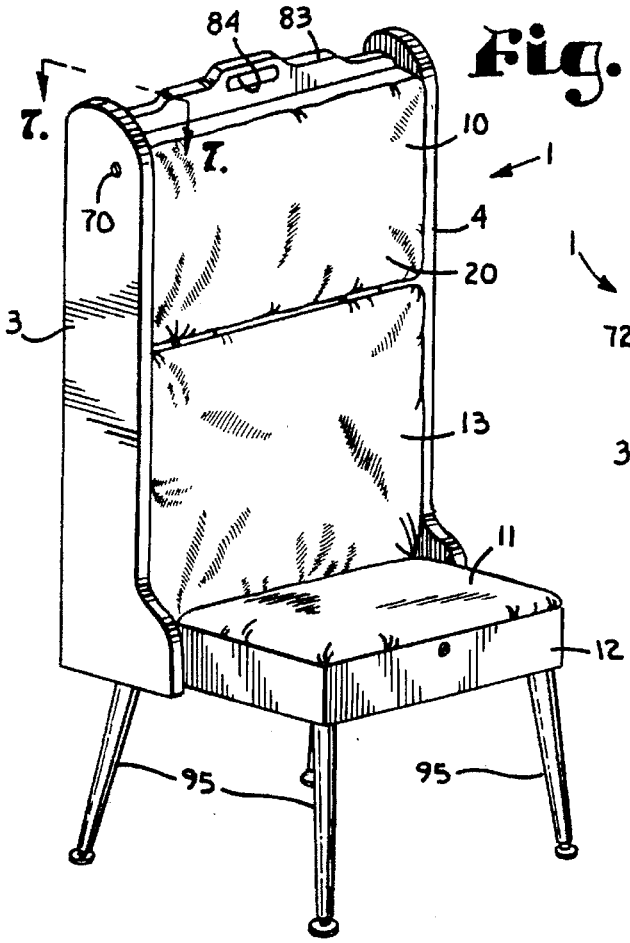
FIG. 1 is a perspective view of the valet of the present invention having an upper storage box, shown in a vertical alignment, and a lower storage box functioning as a seat.
Figure 3:
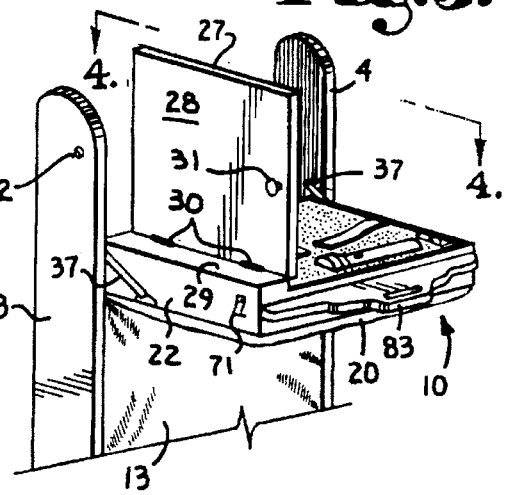
FIG. 3 is a fragmentary perspective view of the valet as shown in FIG. 2 showing a lid of the upper storage box in an open position.
Figure 2:
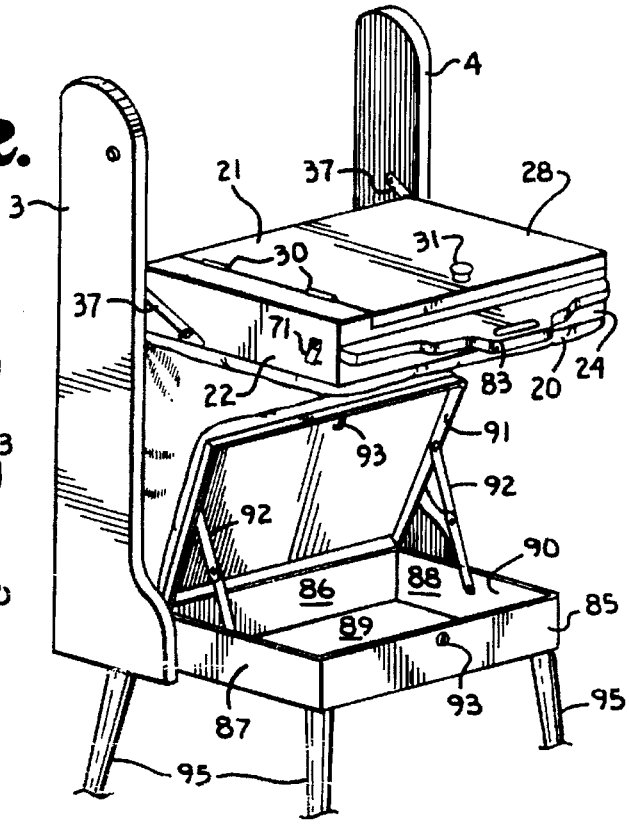
FIG. 2 is a fragmentary perspective view of the valet as shown in FIG. 1 showing the upper storage box pivotally advanced to a horizontal alignment and a lid of the lower storage box in an open position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to a valet of the present invention. The valet 1 includes a frame 2, as best seen in FIG. 5, comprising first and second side frame members 3 and 4, upper and lower cross-braces 5 and 6 and a back board 7 which is secured to the front of and extends between the upper and lower cross-braces 5 and 6.

A first or upper storage box 10 is pivotally secured to the frame 2 generally along the upper cross-brace 5 between the first and second side frame members 3 and 4. A seat 11 comprising a second or lower storage box 12 is secured to and extends horizontally in front of the back board 7 between the first and second side frame members 3 and 4 at a lower end thereof. A lower back support cushion 13 is mounted to the back board 7 between the upper storage box 10 and the seat 11.

The upper storage box 10 includes a front panel 20, a rear panel 21, a first side panel 22, a second side panel 23, a top panel 24 and a bottom panel 25 which define an internal chamber 26. An outer surface of the front panel 20 is preferably padded or includes a padded cushion secured thereto. A first portion 27 of the rear panel 21 forms a lid 28 which is secured to a second portion 29 of the rear panel 21 by hinges 30. A knob 31 is mounted on the lid 28 to provide structure on which a hanger (not shown) may be hung and to facilitate opening and closing of the lid 28. The second portion 29 of the rear panel 21 generally extends adjacent the first side panel 22 such that the lid 28 generally opens from the second side panel 22 to the first side panel 21. The hinges 30 are spaced inward from the first side panel 21 to prevent the first side frame member 3 from obstructing the opening of the lid 28.

The bottom panel 25 of the upper storage box 10 is secured to the upper cross-brace 5 by hinges 35 such that the upper storage box 10 is pivotal between a vertical alignment and a horizontal alignment. In the vertical alignment, the front and rear panels 20 and 21 extend substantially vertically between the first and second side frame members 3 and 4 as shown in FIG. 9. In the horizontal alignment, the front and rear panels extend generally horizontally away from and forward of the first and second side frame members 3 and 4. Support hinges or brackets 37 are mounted between the first side frame member 3 and the first side panel 22 of the box 10 and between the second side frame member 4 and the second side panel 23 of the box 10 to support the upper storage box 10 in a horizontal alignment and prevent the upper storage box 10 from pivoting beyond a horizontal alignment. The support hinges 37 may be mounted in such a manner to prevent the upper storage box 10 from pivoting beyond approximately 40 degrees from vertical. The slightly angled orientation of the upper storage box 10 provides more convenient or comfortable access to the internal compartment 26 of the upper storage box 10 from the rear of the valet 1.

A first layer 40 of compressible material, preferably foam rubber, is positioned in the internal chamber 26 of the upper storage box 10. The first layer 40 of compressible material is sized to generally fill the entire internal chamber 26. A second layer 41 of compressible material, preferably foam rubber, is secured to an inner surface of the lid 28 as shown in FIG. 5. A plurality of item cut-outs 43 are formed in the first layer 40 of compressible material. The item cut-outs 43 are shaped to conform to the shape of items of equipment which are to be stored therein such as a flashlight 44 or handguns (not shown).

As best seen in FIG. 5, an elongated pants leg cut-out or slot 48 is formed in the bottom panel 25 of the upper storage box 10 along an edge 49 of the bottom panel 25 positioned adjacent the lid 28 when the lid 28 is in a closed position. An upper surface of the first layer 40 of compressible material preferably extends slightly beyond the portion of the edge 49 forming the pants leg cut-out 48.

The bottom panel 25 is wider than the upper cross-brace 5 such that when the upper storage box 10 is positioned in the vertical alignment, the pants leg cut-out 48 is positioned rearwardly of the upper cross-brace 5 as shown in FIG. 9.

A strap 51 comprising a first strap section 52 and a second strap section 53 is secured within the upper storage box 10 such that the strap 51 generally extends across an outer surface of the first layer 40 of compressible material. Distal ends of the first and second strap sections 52 and 53 are secured to the upper storage box 10 along the inner surfaces of the first and second side panels 22 and 23. Proximate ends of the first and second strap sections are securable together by a releasable fastener (not shown) such as a hook and loop type fastener. It is foreseen that the strap 51 could be of unitary construction with one end fixedly attached to an inner surface of the upper storage box 10 and the opposite end releasably securable on an opposite side thereof.

The valet 1 includes a first lid locking assembly 55, as shown in detail in FIG. 6, for automatically locking the lid 28 in a closed position when advanced thereto. The first lid locking assembly 55 includes a first portion or bail 56 which is mounted to an inner surface of the lid 28 and a second portion 57 mounted to an inner surface of the second side panel 23. The second portion 57 of the first lid locking assembly 55 comprises a latch 58 mounted on a rotatable hub 59 and a coil spring 60 connected at one end to the latch 58 and at an opposite end to the inner surface of the second side panel 23.

A distal end 65 of the latch 58 is rounded and a notch 66 is formed in a side of the latch 58 to which the spring 60 is attached such that the distal end 65 of the latch 58 generally forms a hook 67. The hub 59 is mounted on and extends through a hole (not shown) in the second side panel 23. The spring 60 normally biases the latch 58 into transverse alignment with the longitudinal axis of the second side panel 23.

The bail 56 is mounted relative to the latch 58 such that as the lid 28 is closed, the bail 56 engages the curved distal end 65 of the latch 58 causing the latch 58 to rotate away from the spring 60 against he biasing force of the spring 60 as shown in phantom lines in FIG. 6. When the lid 28 is completely shut, the bail 56 is aligned with the notch 66 in the latch 58 and the spring 60 pulls the latch back into its normal alignment such that the bail 56 is positioned in the notch 66 and engagement of the bail 56 by the hook 67 prevents the lid 28 from opening.

A key (not shown) may be inserted into a key hole 68 in the hub 59 to rotate the latch 58 and the hook 67 out of engagement with the bail 56. Once the rotating force applied to the key is released, the spring 60 biases the latch 58 back to its normal alignment such that the lid 28 will automatically be locked in the closed alignment when advanced thereto.

The valet 1 includes a storage box locking assembly 70 for automatically locking the upper storage box 10 in the vertical alignment when advanced thereto. The storage box locking assembly, as best seen in FIGS. 7 and 8, comprises a first portion or stop 71 secured to an outer surface of the first side panel 22 of the upper storage box 10 and a second portion 72 secured to the first side frame member 3.

The stop 71 is formed from spring steel and is bent to include a curved or ramped leg 74 and a transverse leg 75. The ramped leg 74 is secured to the outer surface of the first side panel 22, curving away therefrom and extending toward the front panel 20. The transverse leg 75 extends back toward the first side panel 22, perpendicular thereto. A slot 76 is formed in the outer surface of the first side panel 22 adjacent to and coextensive with the transverse leg 75.

The second portion 72 of the storage box locking assembly 70 comprises a latch 80 mounted on a rotatable hub 81 which is mounted in a hole (not shown) extending through the first side frame member 4. The latch 80 is rotatable between a vertical alignment and a horizontal forwardly extending alignment, as shown in phantom lines in FIG. 8, by rotating a key (not shown) inserted in a key hole (not shown) in the hub 81.

The first and second portions 71 and 72 are mounted relative to one another such that when the upper storage box 10 is positioned in the vertical alignment with the latch 80 in vertical alignment, the latch 80 is positioned in front of and generally abuts against the transverse leg 75 of the stop 71 preventing the upper storage box 10 from being pivoted forwardly and downwardly out of the horizontal alignment. When the latch is rotated to the horizontal alignment, the upper storage box 10 can then be rotated to the horizontal alignment. The locking element of the hub 81 is preferably of the type in which the key can only be removed when the latch 80 is in the vertical alignment.

With the latch 80 in the vertical alignment, as the upper storage box 10 is advanced to the vertical alignment, the ramped portion 74 of the stop 71 engages a leading edge of the latch 80 pressing the ramped portion toward the outer surface of the first side panel 22 such that the transverse leg 75 is advanced into the slot 76. As the ramped portion 74 passes completely past the vertically aligned latch 80, the transverse leg 75 is biased back out of the slot 76 into abutting alignment with the latch 80 to automatically lock the upper storage box 10 in the vertical alignment.

The hub 59 of the first lid locking assembly 55 is mounted on the second side panel 23, such that access to the key hole 68 in the second portion 57 of the first lid locking assembly 55 is obstructed or blocked when the upper storage box 10 is positioned or secured in the vertical alignment.

A section of decorative trim 83 having a hand grip slot 84 formed therein is secured to the top panel 24 of the upper storage box 10 to facilitate advancing of the upper storage box between vertical and horizontal alignments.

The lower storage box 12 forming the seat 11 comprises a front panel 85, a rear panel 86, first and second side panels 87 and 88 and a bottom panel 89 which define an internal chamber 90. The lower storage box 12 further includes a lid 91 connected by hinges (not shown) to the rear panel 86. An upper surface of the lid 91 is preferably padded or includes a cushion secured thereto. A pair of support hinges 92 are connected from the lid to the first and second side panels 86 and 87 and are of the type which can selectively hold the lid 91 in an open alignment. A second lid locking assembly 93, generally identical to the first lid locking assembly 55 is secured to the lower storage box 12 for automatically locking the lid 91 when advanced to the closed alignment.

The rear panel 86 of the lower storage box 12 is bolted to the back board 7 as generally shown in FIG. 5. Four legs 95, two of which are secured to and extend below the seat 11 at a front end thereof and two of which are secured to and extend below the lower cross-brace 6 support the seat 11 in spaced relationship above a floor. It is foreseen that the side frame members 3 and 4 for could extend all the way to the floor and function as the legs for the seat 11 or valet 1.

A clothing hook 96 is shown secured o the second side frame member 4. It is foreseen the clothing hooks 96 might be secured to either or both side frame member 3 and 4 or any portion of the valet. The knob 31 is preferably positioned centrally on the rear panel 21 proximate the to panel 24 such that hangers (not shown) for articles of clothing and the like may be supported thereon. A rod 97 is secured to and extends between the first and second side frame members 3 and 4 and is adapted to support articles of clothing such as a tie 98 shown in phantom lines in FIG. 5.

Stops 99, shown in FIG. 5, may be mounted to the first and second side frame members 3 and 4 toward the rear edges thereof to prevent the upper storage box 10 from being urged rearwardly and adding excessive strain on the hinges 30.

Figure 4:
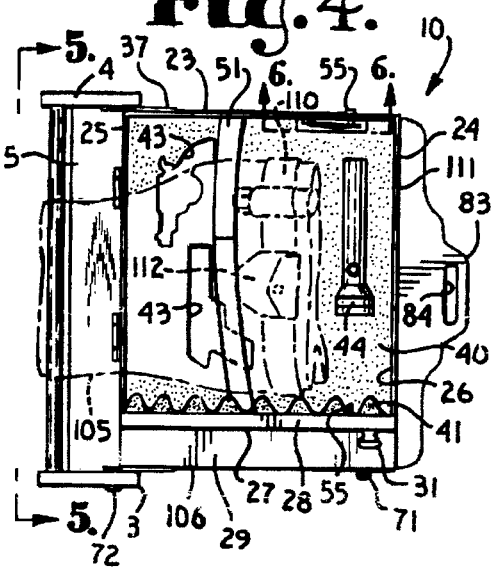
FIG. 4 a view taken generally along line 4—4 of FIG. 3 with a pair of pants shown in phantom lines to show the relative positioning of a pair of pants within the upper storage box for securement therein.

With the upper storage box 10 in the horizontal position and the lid 28 open, a pair of pants 105, shown in phantom lines in FIGS. 4 and 5, may be positioned on the first layer 40 of compressible material such that an upper portion 106 of the pants 105 is supported on the first layer 40 of compressible material and the pants legs 107 extend across the pants leg cut-out 48 and hang or drape downward along the rear of the valet 1. The pants 105 are shown in FIG. 4 with a utility belt 110 secured thereto and the belt 110 has items of equipment 111 secured in holsters 112 on the belt 11. The first and second strap sections 52 and 53 are extended over the upper portion 106 of the pants 105 and fastened together generally snugly against the pants 105. The lid 28 is then closed and automatically locked such that the upper portion 106 of the pants 105 with the belt 110 and items of equipment 111 secured thereto are pressed between the first and second layers 40 and 41 of compressible material.

The upper storage box 10 is then pivoted to an upright alignment and locked in place. The pants legs 107 hang through the pants leg cut-out 48 in the bottom panel 25 of the upper storage box 10. Additional items may be stored in the internal chamber 90 in the seat 11. The legs 95 are preferably sized such that a pair of boots (not shown) of standard size for law enforcement personnel may be positioned under the seat 11.

It is preferable that the locking assemblies 55, 70 and 93 be manufactured such that each utilizes the same key. It is foreseen that a wide variety of locking assemblies could be used instead of those shown. It is preferable however that the locking assemblies provide an automatic locking feature for security purposes.

It is to be understood that while certain forms of the present invention have been illustrated and described herein, it is not to be limited to the specific forms or arrangement of parts described and shown.

What is claimed and desired to be secured by Letters Patent is as follows:

1. A valet comprising:

a. a frame;

b. a storage box having a front panel and a rear panel, an internal chamber formed therein and a lid for providing access to said internal chamber; said storage box pivotally secured to said frame such that said storage box is pivotal between an upright alignment wherein said front and rear panels are substantially vertically aligned and a horizontal alignment wherein said front and rear panels are generally horizontally aligned;

c. a storage box locking assembly at least a portion of which is mounted on said frame for locking said storage box in said upright alignment; and d. a lid locking assembly mounted on said storage box for locking said lid in a closed alignment; said lid locking assembly positioned on said storage box such that access to said lid locking assembly is obstructed when said storage box is positioned in said vertical alignment.

2. The valet as in claim 1 wherein:

a. said frame includes first and second side frame members; and b. said storage box is secured to said frame such that said storage box extends between said first and second side frame members when said storage box is positioned in said vertical alignment.

3. The valet as in claim 2 further comprising:

a. a layer of compressible material secured within said internal chamber of said storage box.

4. The valet as in claim 3 wherein:

a. at least one item cut-out is formed in the layer of compressible material in the shape of an item to be positioned therein.

5. The valet as in claim 1 further comprising:

a. a seat secured to said frame below said storage box.

6. The valet as in claim 3 wherein a storage compartment is formed in said seat.

7. A valet comprising:

a. a frame;

b. a storage box having a front panel and a rear panel, an internal chamber formed therein and a lid for providing access to said internal chamber; said storage box pivotally secured to said frame such that said storage box is pivotal between an upright alignment wherein said front and rear panels are substantially vertically aligned and a horizontal alignment wherein said front and rear panels are generally horizontally aligned;

c. an elongated slot is formed in a bottom panel of the storage box and extends into communication with said internal chamber;

d. a layer of compressible material secured within said internal chamber of said box; and e. a lid locking assembly mounted on said box for selectively locking said lid in a closed alignment.

8. The valet as in claim 7 wherein:

a. said frame includes first and second side frame members; and b. said storage box is secured to said frame such that said storage box extends between said first and second side frame members when said storage box is positioned in said vertical alignment.

9. The valet as in claim 7 further comprising:

a. a box position locking assembly comprising a first portion secured to said storage box and a second portion secured to said frame for locking said storage box in said vertical alignment; and b. said lid locking assembly is positioned on said storage box such that access to said lid locking assembly is obstructed when said storage box is positioned in said upright alignment.

10. The valet as in claim 7 wherein said layer of compressible material comprises a first layer of compressible material and said valet further comprises:

a. a second layer of compressible material secured to an inner surface of said lid.

11. The valet as in claim 7 wherein:

a. at least one item cut-out is formed in the first layer of compressible material in the shape of an item to be positioned therein.

12. The valet as in claim 7 further comprising:

a. a strap securable within said internal chamber of said box to extend above and across said first layer of compressible material.

13. The valet as in claim 7 further comprising:

a. a seat secured to said frame below said storage box.

14. The valet as in claim 13 wherein a storage compartment is formed in said seat.

15. A valet comprising:

a. a frame;

b. a first storage box having a front panel, a rear panel, a first side panel, a second side panel, a top panel and a bottom panel which define an internal chamber; at least a portion of said rear panel comprising a lid hingedly secured to said first storage box; an elongated cut-out is formed in said bottom panel along an edge positioned adjacent said lid when said lid is in a closed position; said first storage box being pivotally secured to said frame such that said first storage box is pivotal between a vertical alignment wherein said front and rear panels are substantially vertically aligned and a horizontal alignment wherein said front and rear panels are generally horizontally aligned;

c. a first layer of compressible material secured within said internal chamber of said first storage box;

d. a second layer of compressible material secured to an inner surface of said lid of said first storage box;

e. storage box locking assembly at least a portion of which is secured to said frame for selectively locking said first storage box in said vertical alignment;

f. a lid locking assembly mounted on said first storage box for selectively locking said lid in a closed alignment; said lid locking assembly positioned on said first storage box such that access to said lid locking assembly is obstructed when said first storage box is positioned in said upright alignment; and g. a seat secured to said frame below said first storage box.

16. The valet as in claim 15 wherein said seat comprises a second storage box having an internal chamber formed therein and having a lid extending substantially across an upper end thereof to provide access to said internal chamber.

17. The valet as in claim 15 wherein:

a. at least one item cut-out is formed in the first layer of compressible material in the shape of an item to be positioned therein.

18. The valet as in claim 15 further comprising:

a. a strap securable within said internal chamber of said first storage box to extend above and across said first layer of compressible material.

19. The valet as in claim 15 wherein:

a. said frame includes first and second side frame members; and b. said storage box is secured to said frame such that said storage box extends between said first and second side frame members when said storage box is positioned in said vertical alignment.

* * * * *